United States Patent [19]

Garcia

[11] Patent Number: 4,970,014

[45] Date of Patent: Nov. 13, 1990

[54] ALUMINUM CLEANING AND BRIGHTENING COMPOSITION AND METHOD OF MANUFACTURE THEREOF

[75] Inventor: Silverio M. Garcia, Louisville, Colo.

[73] Assignee: Chem Shield, Inc., Denver, Colo.

[21] Appl. No.: 456,989

[22] Filed: Dec. 22, 1989

[51] Int. Cl.[5] ..... C09K 13/06; C11D 7/08; C23G 1/02; B44C 1/22

[52] U.S. Cl. ..... 252/79.3; 134/3; 134/40; 156/655; 156/903; 252/79.4; 252/142

[58] Field of Search ..... 252/79.2, 79.3, 79.4, 252/142, 146; 156/634, 655, 656, 665, 903; 134/2, 3, 22.1, 22.11, 22.14, 34, 40, 41

[56] References Cited

U.S. PATENT DOCUMENTS

| | | | |
|---|---|---|---|
| 3,448,055 | 6/1969 | Mickelson et al. | 252/79.3 |
| 3,969,135 | 7/1976 | King et al. | 134/41 |
| 4,181,622 | 1/1980 | Gavin | 252/143 |
| 4,199,469 | 4/1980 | Walzer | 252/146 |
| 4,250,048 | 2/1981 | Leveskis | 252/142 |
| 4,370,173 | 1/1983 | Dollman | 134/3 |
| 4,477,364 | 10/1984 | Garcia | 252/142 |

*Primary Examiner*—William A. Powell

*Attorney, Agent, or Firm*—Donald W. Margolis; John L. Isaac

[57] ABSTRACT

An acidic solution for use as an aluminum cleaning and brightening composition includes an aqueous solution of from about 1–15 weight percent hydrofluoric acid, about 1–5 weight percent sulfuric acid, and about 1–5 weight percent phosphoric acid. In addition, approximately 83–97 weight percent of an aqueous hydrochloric acid-based composition is included, which composition has a pH of less than about 1.0 yet is substantially non-reactive with compounds having low oxidative states, including human skin tissue.

38 Claims, No Drawings

ALUMINUM CLEANING AND BRIGHTENING COMPOSITION AND METHOD OF MANUFACTURE THEREOF

BACKGROUND OF THE INVENTION

Field of the Invention

The present invention relates to cleaning compositions and, more particularly, to strong acid-based cleaning compositions. Specifically, the present invention relates to an aluminum cleaner and brightener composition having a pH value of less than 1.0, yet is nonreactive and nonirritating to human skin tissue.

Description of the Prior Art

Numerous compositions and processes have been employed in the past for the purpose of brightening and cleaning residue, deposits and impurities from aluminum surfaces. Various abrasive techniques have also been used in the past, such as scrubbing, scouring, use of steel wool, sand blasting and the like, for the purpose of removing such materials. In addition, chemical compositions ranging from degreasers and detergents to extremely corrosive acid baths and caustic chemicals, which are difficult and messy to apply, have been used for various shower and bathroom cleaning applications.

Examples of acidic compositions which have been utilized for a wide variety of cleaning applications include U.S. Pat. Nos. 4,675,120, 3,514,407, 3,630,933, 4,116,713, 4,181,622, 4,199,469, and 4,250,048. While many of these referenced patents are not specifically designed for cleaning aluminum and the like, they do disclose acid-based compositions for the purposes of cleaning a wide variety of different types of surfaces. One unfortunate and significant disadvantage of many of these acid-based cleaning compositions is that while they are effective cleaning agents, they can be extremely corrosive and highly reactive with human skin tissue as well as other compositions having relatively low oxidative states. U.S. Pat. No. 4,477,364 discloses an acidic glass cleaning composition which has a low pH value for cleaning yet is relatively innocuous to skin tissue. However, this particular disclosure is directed only to the specific challenges relating to the cleaning of glass surfaces and is so limited thereto.

Abrasive cleaning methods tend to be only temporarily effective and are very destructive and physically tiresome, and the abrasion process tends to scratch the surface being cleaned, thereby removing its natural luster. Moreover, abrasive cleaning tends to be inconsistent in removing excess material from the surface being cleaned and also tends to remove excess metal in some areas and not in others thereby eroding the metal beyond acceptable tolerances. While soaps and degreasing solutions eliminate oil and grease build-up, they generally have negligible effect on oxides and surface discoloration. Moreover, acid-based cleaning solutions tend to react violently with the different aluminum alloys, and the pH values of acid-based cleaning solutions must be carefully controlled to avoid excessive corrosion and damage to the metal surface. The pH values of acid-based cleaning solutions must be low enough to provide the desired oxidation for cleaning, yet it must be sufficiently mild enough to permit ease of handling. Otherwise, strong acid-based solutions require special handling techniques and equipment not readily available to the average household user.

As a result of the above, there is still a need for an effective cleaning and brightening solution particularly applicable to aluminum surfaces such cleaners having requirements different from those of cleaning agents for other types of material surfaces and applications. Such a cleaning composition need not be abrasive, and should be effective in removing residue, deposits and impurities, non-corrosive to the aluminum surface being cleaned, and non-reactive with human skin tissue to permit easy and safe use by individuals applying the solution.

SUMMARY OF THE INVENTION

Accordingly, it is one object of the present invention to provide an improved and effective aluminum cleaning and brightening solution.

It is another object of the invention to provide an acid-based cleaning solution for aluminum surfaces having an extremely low pH capable of highly effective removal of residue, deposits and impurities from the surface being cleaned.

It is a further object of the present invention to provide an acid-based cleaning solution as described above which is also non-toxic and non-reactive to healthy human skin tissue and other compounds having low oxidative states to permit ease of handling.

To achieve the above and other objects and advantages of the present invention, an acidic solution for use as a aluminum cleaning and brightening composition is disclosed. The solution includes an aqueous solution of from about 1–15 weight percent hydrofluoric acid, about 1–5 weight percent sulfuric acid, and about 1–5 weight percent phosphoric acid. To this solution is added an additional 83–97 weight percent of an aqueous hydrochloric acid-based composition having a pH less than about 1.0, yet substantially non-reactive with compounds having low oxidative states including human skin tissue.

DETAILED DESCRIPTION OF THE PREFERRED EMBODIMENTS

By way of background, acids are hydrogen-containing substances which dissociate in water to produce one or more hydrogen ions. The concentration of hydrogen ions in a solution is known, of course, as the pH. In aqueous solutions, hydrogen ions ($H^+$) bond to one or more water molecules, and the ion formed when one hydrogen ion bonds to one water molecule is called the hydronium ion ($H_3O^+$). In dilute aqueous solutions, all strong acids donate a proton to water and are essentially 100% ionized to produce a solution containing hydronium ions plus the anions of the strong acid.

According to the principles established in the Bronstead-Lowry Theory, the acid dissociation reaction of each acid is different. This creates both strong acids and weak acids which in turn have conjugate bases that are correspondingly weak and strong, respectively. Also, by combining a weak acid with its conjugate acid salt, an acid solution is created which shows a moderate pH value at equilibrium.

When strong acids are mixed together, a great number of hydrogen ions are released and become available for further chemical reaction. If these strong acids are then further mixed with weak acids in the presence of water, the conjugate bases of the weaker acids that are formed in the reaction then serve as strong bases and function as regulators of the hydrogen ions produced by the strong acid combination.

When hydrochloric acid (HCl), a strong acid, is mixed with water, HCl virtually completely ionizes in dilute aqueous solution. The reaction between hydrochloric acid and water produces a high hydronium ion concentration, and the total hydronium ion concentration in this reaction comes from two sources: first, from the hydrochloric acid dissociation, and second, from the self-ionization of the water. The concentration of hydronium ions due to self-ionization of water is almost negligible but is quite substantial due to the hydrochloric acid dissociation. This is also the case with virtually all strong acids, and it is therefore customary to neglect the self-ionization concentration from all calculations. When this ionization of strong acid occurs, it is virtually impossible to distinguish among the strengths of the strong acids such as sulfuric acid, hydrochloric acid, HI, etc., when dealing with them in aqueous solutions. All of these aqueous solutions contain the same strong acid, namely the hydronium ion.

Water, under these circumstances, functions as a leveling agent on the strengths of all very strong acids, and their acidities are reduced to the level of the hydronium ion present in solution. The water increases the ionization disbursements and is the carrier for the entire electrolysis system. One of the advantages of this approach is its emphasis on the competitive nature of acid-base equilibrium in protonic solvents. Since the solvated hydrogen ion is the strongest acid that can exist in these solvents, the conjugate base of each acid competes for it. The strongest base reacts with the hydrogen ion to form the weaker undissociated acid.

It has been found that by changing the combinations of acids and their concentrations, the behavior of the strong acid can be controlled, and the amount of available hydrogen ions can be increased or decreased to accelerate or slow down the reaction. When this is done, acid solutions with extremely low pH values and high amounts of free hydrogen ions can be formulated. These solutions are found to be non-corrosive to metal, innocuous to skin and capable of providing enormous amounts of hydrogen ions that, when combined with other acids, provide an excellent environment for effective performance in cleaning, disinfecting and preparation of all kinds of surfaces.

For example, when we add hydrochloric acid to these solutions, the resulting formula exhibits the pH of the totally ionized HCl. The hydrogen ion becomes bound, and the solution subsequently releases it in proportion to the oxidation state of the substance with which it comes in contact.

As explained above, the weaker acids in the aqueous acidic solution function as strong bases that hold the hydrogen ion in shifting electron sharing. The presence of compounds of a higher oxidative state de-stabilize the hold and free the hydrogen ions. If, in turn, the solution comes in contact with compounds that have extremely low oxidative states, such as unbroken human skin or even sclera of guinea pigs or rabbits, there is little or no reactivity at all.

The present invention provides an improved acidic solution for use as an aluminum cleaner and brightener for removal of residue, deposits and impurities from aluminum surfaces of all types. The solution comprises from about one to about fifteen weight percent of an aqueous solution containing one to fifteen weight percent hydrofluoric acid, from about one to five weight percent sulfuric acid, from about one to five weight percent phosphoric acid, and from about 83 to about 97 weight percent of an aqueous hydrochloric acid-based composition having a pH value of less than about 1.0 which is substantially non-reactive with compounds having low oxidative states including human skin tissue.

The aqueous acid-based composition of the end product, which is formed from selected inorganic and organic acids, possesses unique properties. Specifically, the aqueous acid-based composition has strong acid properties, i.e. a pH value of less of about 0.91, and yet is substantially inert to healthy human skin so that contact of the aqueous acid-based composition with a user's skin does not result in burns or even irritation to the skin of the user.

The end solution of the preferred embodiment is a product of mixing a very strong acid with a plurality of weaker acids in the presence of water in such a manner that the conjugate bases of the weaker acids function as strong bases to control the production of hydronium ions in the strong acid. The main source of hydronium ions in the solution is the hydrochloric acid as it dissociates in water. This dissociation is virtually uncontrolled and requires the other weaker acids to create the conjugate strong bases to bring this production of hydronium ions under control. The composition of the end product can vary and will be dependent on the aluminum alloy that is being cleaned and whether the formulation is being put together for general cleaning and janitorial use or for industrial use in sophisticated pieces of equipment such as airplane turbines, fuselage or aluminum machinery.

The second essential ingredient of the solution of the present invention is the aqueous acid-based composition having a pH value of less than about 1.0. The unique aqueous acid-based composition is prepared by a process wherein the ingredients are believed to be critical. Moreover, the specific order of addition of the ingredients used in the formulation of the aqueous acid-based composition is also critical, and especially desirable results have been obtained when the aqueous acid-based composition is prepared in accordance with the procedure described below.

More particularly, the hydrochloric acid-based composition includes an aqueous hydrochloric acid solution admixed with an effective amount of at least one weak acid to produce strong conjugate bases to control the dissociation production of hydronium ions by the hydrochloric acid in solution. A more preferred embodiment includes a solution of hydrochloric acid and phosphoric acid admixed with an effective amount of at least one weak organic acid to produce strong conjugate bases.

The preferred embodiment is an acidic solution wherein the 83–97 weight percent aqueous hydrochloric acid-based composition includes an aqueous mixture of about 5–20 weight percent hydrochloric acid with about 5–20 weight percent phosphoric acid admixed with approximately 1–5 weight percent of any suitable hydroxy carboxylic acid and approximately 1–5 weight percent of a suitable dicarboxylic acid. In preferred form, the hydroxy carboxylic acid may be selected from any one of the group including citric acid, tartaric acid and malic acid, although the preferred embodiment includes citric acid. Moreover, the dicarboxylic acid of the solution may be selected from any one of the group consisting of oxalic acid, malonic acid, succinic acid, glutaric acid, and adipic acid, although the preferred dicarboxylic acid is oxalic acid. The hydrochloric acid-based composition may further include 1–3 weight percent of a poly methyl amine which is preferably selected from hexamethylenetetramine, hexamethylenediamine and hexamethyleneamine, although hexamethylenetetramine is the preferred embodiment. Moreover, the solution may also include approximately 2–3 weight percent of an acid thickening agent to provide an overall thickening capability to the composition for application as a shower cleaner.

The most preferred composition as an aluminum cleaning and brightening material includes approximately 10% hydrofluoric acid, 1% sulfuric acid, 1% phosphoric acid (d=1.70 g/cc) and 86% of the hydrochloric acid-based composition as described above that has a pH of less than about 1.0. Moreover, approximately 2% of an acid-thickening agent is preferably added to this most preferred composition, the preferred thickening agent being marketed under the trade name BIO-SOFT TA-2 manufactured by Exxon Chemicals.

The initial step in the preparation of the preferred aqueous acid-based composition of the solution of the present invention comprises admixing from about 5 to about 20 weight percent hydrochloric acid with about 5 to about 20 weight percent phosphoric acid in a vessel for an effective period of time to provide a substantially homogeneous acidic mixture. Because strong fumes are emitted upon mixing the hydrochloric acid and the phosphoric acid, care should be exercised in the mixing of the two components to insure that the mixing step is carried out in a well ventilated area or hood. The time required to mix the hydrochloric acid and phosphoric acid so as to provide a substantially homogeneous acidic mixture can vary widely and will generally depend upon the rate of addition of the two components, amounts of the two components, the rate or speed of agitation and the like. However, approximately 10–20 minutes mixing time will generally produce a homogeneous mixture.

The homogeneous acidic mixture formed from the hydrochloric acid and phosphoric acid is then admixed with an effective amount of water, preferably distilled water, to provide an aqueous acidic mixture. The amount of water employed in the formulation of the aqueous acidic mixture can vary widely, but is generally an amount sufficient to provide from about 47 to about 87 weight percent water in the aqueous acidic mixture. The aqueous acidic mixture is thoroughly stirred to insure substantially complete dispersion of the homogeneous acidic mixture of the hydrochloric acid and the phosphoric acid into the water and to provide a substantially uniform aqueous acidic mixture.

This aqueous acidic mixture is then agitated, and from about 1 to about 5 weight percent of a hydroxy carboxylic acid and from 1 to about 5 weight percent of a dicarboxylic acid are then preferably admixed therewith. These weak acids are added to further control the dissociation reaction and production of hydronium ions. As indicated above, the hydroxy carboxylic acid and the dicarboxylic acid are both critical ingredients in the formulation of this preferred aqueous acid-based composition. The amount of hydroxy carboxylic acid and dicarboxylic acid incorporated into the aqueous acidic mixture of the hydrochloric acid and phosphoric acid can vary widely within the ranges set forth hereinabove. However, the optimum amounts of hydroxy carboxylic acid and dicarboxylic acid admixed with the aqueous acidic mixture are the amounts required to provide from about 1 to about 5 weight percent of the hydroxy carboxylic acid and from about 1 to about 5 weight percent of the dicarboxylic acid in the aqueous acid-based composition.

Any suitable hydroxy carboxylic acid may be employed in the preparation of the aqueous acid-based composition of the solution of the present invention. Typical of such hydroxy carboxylic acids are citric acid, tartaric acid, malic acid, and the like. However, especially desirable results have been obtained wherein the hydroxy carboxylic acid added to the aqueous acidic mixture is citric acid.

Any suitable dicarboxylic acid may be employed in the preparation of the aqueous acid-based composition of the solutions of the present invention for controlling hydronium ion production. Typical of such dicarboxylic acids are oxalic acid, malonic acid, succinic acid, glutaric acid, adipic acid, and the like. Desirable results have been obtained when the dicarboxylic acid added to the aqueous acidic mixture is oxalic acid.

The aqueous acid-based composition so produced will preferably contain from about 40 to about 90 weight percent water, and more preferably from about 47 to 87 percent water. Thus, depending upon the amount of hydroxy carboxylic acid and dicarboxylic acid added to the aqueous acidic mixture, as well as the amount of water initially added to the acidic mixture formed by the hydrochloric acid and the phosphoric acid, it may be desirable to further dilute the aqueous acid-based composition with an effective amount of water to insure that the concentration of water in the aqueous acid-based composition is from about 40 to about 90 weight percent, and preferably from about 47 to about 87 weight percent. In those instances where it is determined that the amount of water present in the aqueous acid-based composition is less than the specified amount, the aqueous acid-based composition is admixed with an effective amount of water so as to provide the aqueous acid-based composition of the solution with the desired amount of water.

When the weak acids added to further control the dissociation reaction are oxalic and citric acids, in the presence of water, the oxalic acid also provides a secondary source of hydronium ions and is of extreme importance in regulating the pH of the end product. The more oxalic acid added to the formulation, the lower the pH and the more active the solution becomes with respect to the removal of oxides and carbonates from bathroom shower installation surfaces. The citric acid provides the final controller of excess hydronium ions that might have been created by the addition of oxalic acid. If more oxalic acid is added to the solution, more citric acid must be added. Otherwise, the solution may lose its ability to remain innocuous and inert to skin and other organic materials of low oxidative states.

The aqueous acid-based composition used in the solution of the present invention is a substantially colorless liquid having an appearance substantially similar to water. Further, the aqueous acid-based composition prepared as set forth hereinbefore, has a pH value of less than 1.0, i.e. about 0.91 and as low as 0.2, and is substantially inert to healthy human skin and other organic materials having low oxidative states.

Once the above mixture is accomplished, an effective minor amount of a poly methyl amine may be selectively admixed with the aqueous acid-based composition to provide an amine-containing aqueous acid-based composition. When this is done, the concentration of acids in the solution can be increased without generating excess gases.

The effective minor amount of the poly methyl amine incorporated into the aqueous acid-based composition used in the formulation of the amine-containing solution can vary widely, but will generally range from about 1 to about 3 weight percent. Further, any suitable poly methyl amine compatible with the aqueous acid-based composition may be employed. Typical of such poly methyl amines are hexamethylenetetramine, hexamethylenediamine, hexamethyleneamine and the like. However, desirable results have been obtained where the poly methyl amine is hexamethylenetetramine, and the hexamethylenetetramine is incorporated into the aqueous acid-based composition in an amount to provide from about 1 to about 3 weight percent of the poly methyl amine in the amine-containing solution employed.

Through experimentation, it has been found that the final end product, when in combination with other acids including up to 50% by volume in certain cases, provides the user of these acidic solutions with a plurality of products that can be used in aluminum cleaning and brightening, disinfecting and surface preparation while retaining the safe handling properties of the original product, including that of being innocuous to skin and other organic materials. Moreover, in certain applications it has been found highly desirable to provide an acid thickening agent to increase the fluid density and increase viscosity. In preferred form, approximately 2–3 weight percent of an acid thickening agent may be added to the acid composition. While any suitable thickening agent may be used, the trademarked material "BIO-SOFT T.A. 2" manufactured by Exxon Chemical is preferred as previously indicated.

All mixing and storage containers employed in the production of the acidic compositions of the present invention are preferably fabricated of a substance that is acid resistant, such as stainless steel, plastic, Fiberglas, glass, and the like. It is also preferred that all containers used in the process of the present invention be provided with covers for safety reasons and to keep foreign materials out of the product, especially the container in which the hydrochloric acid and the phosphoric acid are mixed.

The aqueous acid-based composition produced as set forth above is an essential ingredient in the formulation of the aluminum cleaner and brightener compositions of the present invention. In the preparation of the acidic aluminum cleaner, the hydrofluoric acid, the sulfuric acid and the phosphoric acid are admixed together in a properly ventilated area and using the proper mixing equipment, while maintaining constant agitation. This acidic solution is then added to the aqueous acid-based composition until a substantially uniform mixture is obtained. It is to be noted that the aqueous acid-based composition is preferably maintained under constant agitation during the mixing of the shower cleaner solution so that the resulting acidic composition is a substantially homogeneous solution.

The time required to thoroughly mix the acidic solution with the aqueous acid-based composition to form the aluminum cleaner composition can vary widely, and the mixing time and period will generally depend on the rate of addition of the acidic solution to the aqueous acid-based composition, the amount of hydrofluoric acid employed in the formulation of the initial acidic solution, and the rate of speed of agitation of the aqueous acid-based composition during the addition of the initial acidic solution.

In order to more fully describe the present invention, the following examples are set forth. However, it is to be understood that these examples are for illustrative purposes only and are not to be construed as limiting the scope of the present invention as defined in the appended claims.

EXAMPLE I

Preparation of Aqueous Acid-based Composition 72 pounds of hydrochloric acid and 42 pounds of phosphoric acid were added to an acid-resistant container, and the acids were stirred to produce a substantially homogeneous acidic mixture. During the mixing of the hydrochloric acid and the phosphoric acid, fumes were generated. Thus, the mixing was carried out in a well-ventilated area.

330 pounds of water were then placed into a second container, and 114 pounds of the hydrochloric-phosphoric acid mixture were added to the water in the second container. The resulting aqueous acidic solution was thoroughly mixed. Thereafter, 22 pounds of powdered citric acid and 15 pounds of powdered oxalic acid were admixed into the aqueous acidic mixture to produce an aqueous acidic composition.

The aqueous acidic composition was then diluted by admixing 481 pounds of the aqueous acidic composition with 330 pounds of water in a third container. The aqueous acidic composition and water were thoroughly stirred and provided approximately 97 gallons of an aqueous acid-based composition having a pH value of about 0.49, which composition was non-reactive with healthy human tissue despite the extremely low pH.

The mixing and storage containers employed were formed of materials substantially acid resistant. Further, all containers were covered for safety reasons and to prevent foreign materials from being injected into the aqueous acid-based composition.

EXAMPLE II

Preparation of an Amine-Containing Aqueous Acid-Based Composition

In the preparation of an amine-containing aqueous acid-based composition, the same steps and procedures set forth in Example I for the preparation of the basic aqueous acid-based composition were carried out. Following the dilution of the aqueous acid-based composition described above, 17 pounds of hexamethylenetetramine were admixed into about 811 pounds of the aqueous acid-based composition, and mixing continued until a substantially homogeneous colorless liquid was formed. Approximately 100 gallons of the amine-containing aqueous acid-based composition was formed using this procedure, and the amine-containing aqueous acid-based composition had a pH value of about 0.91 and was innocuous when put into contact with human skin tissue.

As in the preparation of the aqueous acid-based composition of Example I, all mixing and storage containers employed were acid resistant containers. Further, each of the containers was covered for safety reasons and to prevent foreign materials from being introduced into the product.

EXAMPLE III

Preparation of an Aluminum Brightner Solution 10 gallons of hydrofluoric acid (HF) were added to 88 gallons of the amine containing aqueous acid-based composition of Example II above. The hydrofluoric acid was added carefully in an acid resistant container, and was stirred until a substantially homogeneous acidic mixture was obtained. To the resulting 98 gallons of mixture, 1 gallon of sulfuric acid (H2SO4) and 1 gallon of phosphoric acid (H3PO4) were also carefully admixed and stirred until a substantially homogeneous acidic mixture was obtained. Samples of this end solution were used as an aluminum cleaner and brightner solution in the Examples that follow.

EXAMPLE IV

Cleaning of Aluminum Railing and Aluminum Fixtures

The end product of Example III above was used as a cleaning and brightner solution in the aluminum fixtures and hand railing of an office building by simply applying the product with a rag that had been previously soaked in the solution of Example III above. The wet rag was then used to wipe the fixtures and railing clean. The job was done fast and efficiently, and the different fixtures and hand railing were left clean and shiny, without spots, rust, grease, hand prints or discoloration spots. For safety measures, the technician wore rubber gloves during the application of the product. However, the product was inert and nontoxic to human skin.

EXAMPLE V

Cleaning of Aluminum Blades

The aluminum blades section of a gas compression turbine was dipped into a vat containing the end product of Example III above for a period of 7 minutes. No adverse reactions were observed coming from the surface of the blades during the time that the blades were immersed in the solution of Example III, and no corrosion occurred. After the 7 minutes, the aluminum blade section of the turbine was removed from the vat, washed thoroughly with water and air dried.

A complete observation was made of the different parts of the section, including those parts of different aluminum alloys. It was found that the whole blade section was clean and spotless and showed no evidence whatsoever of having been affected adversely by the acid solution of Example III above. After the test was completed, metal thickness tolerances were measured in a sample of 10 individual blades that had been previously chosen before the test began. These blades were found to be the same as before the test was performed, thereby indicating that none of the metal surface had been corroded or removed.

EXAMPLE VI

Cleaning of an Airplane Fuselage

The fuselage of a small airplane needed to be cleaned and prepared for priming and painting. The acid solution of Example III above was used in combination with 2% of an acid thickener to give it more viscosity. This solution was then brushed over the fuselage area to be cleaned. The thickened solution of Example III above was left on the fuselage for a period of 10 minutes. After the 10 minutes, the thickened solution was washed off with water from a water hose and left to dry. Once the surface was dried, it was inspected for evidence of corrosion, hydrogenation, pitting or other damage that could have been caused by the action of the acid. None was found, and the fuselage was promptly painted.

As can be seen from the above, the present invention provides a highly effective aluminum cleaner and brightener composition which has as a basis for cleaning an acidic solution with a very low pH. The advantage of the present invention, as clearly seen from the above, is that while the pH of the solution is very low to provide highly effective cleaning, the pH is not so toxic as to cause damage to the surfaces. Moreover, due to the unique nature of the present invention, the low pH acid-based composition of the invention is innocuous to human skin tissue as well as being non-reactive with other organic compositions of low oxidative states. This is substantially different from strong acid-based or caustic cleaning solutions presently on the market which require very special handling and which can create toxic fumes either during use or during the mixture thereof. Finally, the present invention is readily biodegradable so that it may be flushed down the drain without any environmental concerns or toxicity problems.

While this invention has been particularly shown, described and illustrated with reference to preferred embodiments and modifications and examples thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments in which an exclusive property or privilege is claimed are defined as follows:

1. An acidic solution for use as a aluminum cleaning and brightening composition comprising an aqueous solution of from about 1–15 weight percent hydrofluoric acid, about 1–5 weight percent sulfuric acid, about 1–5 weight percent phosphoric acid, and about 83–97 weight percent of an aqueous hydrochloric acid based composition having a pH of less than about 1.0, yet substantially non-reactive with compounds having low oxidative states including human skin tissue.

2. The acidic solution of claim 1, wherein said hydrochloric acid-based composition comprises a dilute, aqueous hydrochloric acid-based solution admixed with an effective amount of at least one weak acid to produce strong conjugate bases to control the disassociation production of hydronium ions.

3. The acidic solution as claimed in claim 2, wherein said hydrochloric acid-based composition comprises a dilute aqueous solution of hydrochloric acid and phosphoric acid admixed with an effective amount of at least one weak organic acid to produce strong conjugate bases to further control hydrochloric acid disassociation production of hydronium ions.

4. The acidic solution as claimed in claim 3, wherein said hydrochloric acid-based composition comprises an aqueous mixture of about 5–20 weight percent hydrochloric and about 5–20 weight percent phosphoric acid admixed with approximately 1–5 weight percent of an hydroxy carboxylic acid and approximately 1–5 weight percent of a dicarboxylic acid.

5. The acidic solution as claimed in claim 4, wherein said hydrochloric acid based composition further comprises about 1–3 weight percent of a poly methyl amine.

6. The acidic solution as claimed in claim 4, wherein said hydroxy carboxylic acid is selected from the group consisting of citric acid, tartaric acid, and malic acid.

7. The acidic solution as claimed in claim 6, wherein said hydroxy carboxylic acid is comprised of citric acid.

8. The acidic solution as claimed in claim 4, wherein said dicarboxylic acid is selected from the group consisting of oxalic acid, malonic acid, succinic acid, glutaric acid and adipic acid.

9. The acidic solution as claimed in claim 8, wherein said dicarboxylic acid comprises oxalic acid.

10. The acidic solution as claimed in claim 5, wherein said poly methyl amine is selected from the group consisting of hexamethylenetetramine, hexamethylenediamine and hexamethyleneamine.

11. The acidic solution as claimed in claim 10, wherein said poly methyl amine comprises hexamethylenetetramine.

12. The acidic solution as claimed in claim 4, wherein said solution further comprises approximately 2–3 weight percent of an acid thickening agent.

13. The acidic solution as claimed in claim 1, wherein said solution comprises an aqueous solution of approximately 10 weight percent hydrofluoric acid, approximately 1 weight percent sulfuric acid, 1 approximately weight percent phosphoric acid, and approximately 86 weight percent of said aqueous hydrochloric acid-based composition.

14. The acidic solution as claimed in claim 13, wherein said hydrochloric acid-based composition comprises an aqueous mixture of about 5–20 weight percent hydrochloric acid and about 5–20 weight percent phosphoric acid admixed with approximately 1–5 weight percent of an hydroxy carboxylic acid and approximately 1–5 weight percent of a dicarboxylic acid.

15. The acidic solution as claimed in claim 14, wherein said hydroxy carboxylic acid is selected from the group consisting of citric acid, tartaric acid, and malic acid, and wherein said dicarboxylic acid is selected from the group consisting of oxalic acid, malonic acid, succinic acid, glutaric acid and adipic acid.

16. The acidic solution as claimed in claim 15, wherein said hydroxy carboxylic acid comprises citric acid, and wherein said dicarboxylic acid comprises oxalic acid.

17. The acidic solution as claimed in claim 16, wherein said hydrochloric acid-based composition further comprises about 1–3 weight percent of a poly methyl amine.

18. The acidic solution as claimed in claim 17, wherein said solution further comprises approximately 2–3 weight percent of an acid thickening agent.

19. A process for preparing an acidic solution for use as an aluminum cleaning and brightening composition having a pH of less than about 1.0 while being non-reactive with human skin tissue, comprising admixing approximately 1–15 weight percent hydrofluoric acid with approximately 1–5 weight percent sulfuric acid and 1–5 weight percent of a phosphoric acid, and further admixing this acid solution with about 83–97 weight percent of an aqueous acid-based composition, said aqueous acid-based composition being prepared by the steps of:

admixing from about 5–20 weight percent hydrochloric acid with about 5–20 weight percent phosphoric acid to produce an acidic mixture; and admixing said acidic mixture with an effective amount of water to produce an aqueous acid-based composition having approximately 47–87 weight percent water.

20. The process as claimed in claim 19, wherein said aqueous acid-based composition is admixed with an effective amount of at least one weak organic acid to produce strong conjugate bases to control hydrochloric acid dissociation production of hydronium ions therein.

21. The process of claim 20, wherein said aqueous acid-based composition is further admixed with approximately 1–5 weight percent of a hydroxy carboxylic acid and with from about 1–5 weight percent of a dicarboxylic acid.

22. The process as claimed in claim 21, wherein said hydroxy carboxylic acid is selected from the group consisting of citric acid, tartaric acid, and malic acid.

23. The process as claimed in claim 21, wherein said dicarboxylic acid is selected from the group consisting of oxalic acid, malonic acid, succinic acid, glutaric acid and adipic acid.

24. The process as claimed in claim 21, wherein said hydroxy carboxylic acid comprises citric acid and said dicarboxylic acid comprises oxalic acid.

25. The process as claimed in claim 21, wherein said acid-based composition is further admixed with a poly methyl amine.

26. The process as claimed in claim 19, wherein said 5–20 weight percent phosphoric acid functions as a controller for hydronium ion production by the disassociation of hydrochloric acid in water, and wherein said hydronium ion production is further controlled by adding an effective amount of yet another weak acid.

27. The process as claimed in claim 26, wherein said weak acid comprises hydroxy carboxylic acid, and further comprises the step of adding yet a third weak acid to control hydronium ion production created by the disassociation of hydrochloric acid in water as well as created by the addition of said hydroxy carboxylic acid.

28. The process as claimed in claim 27, wherein said additional weak acid comprises a dicarboxylic acid.

29. An acidic aluminum cleaning and brightening composition comprising approximately 1–15 weight percent of an aqueous solution containing from about 1–15 weight percent hydrofluoric acid, approximately 1–5 weight percent sulfuric acid, approximately 1–5 weight percent phosphoric acid, and approximately 83–97 weight percent of an aqueous hydrochloric acid-based composition having a pH of approximately less than 1.0 and prepared by the steps of:

admixing from about 5–20 weight percent hydrochloric acid with about 5–20 weight percent phosphoric acid to produce an acidic mixture; and admixing said acidic mixture with an effective amount of water to produce an aqueous acid-based composition having approximately 47–87 weight percent water.

30. A aluminum cleaning and brightening composition as claimed in claim 29, wherein said aqueous acid-based composition is admixed with an effective amount of at least one weak organic acid to produce strong conjugate bases to control hydrochloric acid dissociation production of hydronium ions therein.

31. The aluminum cleaning and brightening composition of claim 30, wherein said aqueous acid-based composition is further admixed with approximately 1–5 weight percent of a hydroxy carboxylic acid and with from about 1–5 weight percent of a dicarboxylic acid.

32. The aluminum cleaning and brightening composition as claimed in claim 31, wherein said hydroxy carboxylic acid is selected from the group consisting of citric acid, tartaric acid, and malic acid.

33. The aluminum cleaning and brightening composition as claimed in claim 31, wherein said dicarboxylic acid is selected from the group consisting of oxalic acid, malonic acid, succinic acid, glutaric acid and adipic acid.

34. The aluminum cleaning and brightening composition as claimed in claim 31, wherein said hydroxy carboxylic acid comprises citric acid and said dicarboxylic acid comprises oxalic acid.

35. The aluminum cleaning and brightening composition as claimed in claim 31, wherein said acid-based composition is further admixed with a poly methyl amine.

36. The aluminum cleaning and brightening composition as claimed in claim 29, wherein said 5–20 weight percent phosphoric acid functions as a controller for hydronium ion production by the disassociation of hydrochloric acid in water, and wherein said hydronium ion production is further controlled by adding an effective amount of yet another weak acid.

37. The aluminum cleaning and brightening composition as claimed in claim 36, wherein said weak acid comprises hydroxy carboxylic acid, and further comprises the step of adding yet a third weak acid to control hydronium ion production created by the disassociation of hydrochloric acid in water as well as created by the addition of said hydroxy carboxylic acid.

38. The aluminum cleaning and brightening composition as claimed in claim 37, wherein said additional weak acid comprises a dicarboxylic acid.

* * * * *